United States Patent [19]

Senkowski et al.

[11] Patent Number: 4,878,430

[45] Date of Patent: Nov. 7, 1989

[54] DETONATOR PELLET

[75] Inventors: Gottfried Senkowski, Troisdorf; Joachim Sturm, Lohmar, both of Fed. Rep. of Germany

[73] Assignee: Dynamit Nobel Aktiengesellschaft, Troisdorf, Fed. Rep. of Germany

[21] Appl. No.: 254,877

[22] Filed: Oct. 7, 1988

[30] Foreign Application Priority Data

Oct. 20, 1987 [DE] Fed. Rep. of Germany ..... 3735405

[51] Int. Cl.[4] ..... F42C 19/12

[52] U.S. Cl. ..... 102/202.9; 102/202.5

[58] Field of Search ..... 102/202.5, 202.7, 202.9, 102/202.11, 202.14

[56] References Cited

U.S. PATENT DOCUMENTS

| | | | |
|---|---|---|---|
| 2,240,438 | 4/1941 | Durant | 102/202.14 |
| 3,134,329 | 5/1964 | Zeman | 102/202.7 |
| 4,621,578 | 11/1986 | Vallieres et al. | 102/202.9 |
| 4,690,063 | 9/1987 | Granier et al. | 102/202.5 |

*Primary Examiner*—Charles T. Jordan

*Attorney, Agent, or Firm*—Antonelli, Terry & Wands

[57] ABSTRACT

A detonator pellet includes a composite insulating member made of a synthetic resin or a ceramic material, two wires being embedded during manufacture of the member which wires extend in and, respectively, on surfaces of a central part of the insulating member so that the wires, in this way, are supported so well that an ignition bridge can be directly attached to the ends of the wires by soldering, welding or bonding.

6 Claims, 1 Drawing Sheet

DETONATOR PELLET

This invention relates to a detonator pellet having a composite insulating member with wires extending therethrough to an ignition bridge.

A conventional detonator pellet consists of a glass base surround by a metal ring with two contact pins, a pole piece carrying the ignition bridge at the front and being encompassed in droplet shape by an initiator mixture by dipping. In general, glass is a material unsuitable for the pole piece because the initiator mixture does not adhere thereto with adequate firmness. The connection of the ignition bridge at the front of the pole piece with the two contact pins in the glass base is effected by way of laminated conductor paths on both sides of the pole piece; this requires four soldering or welding sites.

It is an object of the invention to simplify the structure of such detonator pellets and to render manufacture of detonator pellets less expensive.

The object has been attained by a detonator pellet including a composite insulating member with two wires that extend all the way through the member to the ignition bridge and that are supported by the composite insulating member.

The composite insulating member of this invention combines the previously separate parts of the base associated with contact pins and the pole piece associated with the ignition bridge. Advantageously, this member does not consist of glass on account of inadequate adhesion of the initiator mixture to glass. Especially suitable materials for forming this member are synthetic resins suited for injection molding, e.g. polyamide, or ceramic materials shaped by pressing and having strength imparted thereto by sintering, for example, an aluminum oxide ceramic material. The composite insulating member can be produced in one operating step with the wires incorporated up to the zone or location of the ignition bridge. This eliminates the bilateral electrically conductive connection of the ignition bridge with the base along the pole member. The feature of this invention of extending the wires up to the ignition bridge is impossible in the conventional detonator pellets for mechanical reasons. This feature is only possible because, according to this invention, the wires extend on both sides of a central part (which part forms the pole member) at least partially or entirely within the composite insulating member. Inasmuch as the required rigidity of the leads is ensured in this way, the ignition bridge, which is a wire of an order of magnitude with a diameter of 0.1 mm, can be directly attached to the ends of the wires.

The composite insulating members according to this invention with the passed-through and partially embedded wires can be manufactured in one piece, for example, by injecting molding of a synthetic resin. Since difficult soldering or welding operations are necessary merely twice per detonator pellet in this arrangement, the reject quota is greatly reduced. Moreover, expenses are also saved additionally with respect to the material consumed.

Heretofore, the general opinion has been that synthetic resin is unsuitable as a material for producing such detonator pellets since synthetic resin apparently does not exhibit high temperature and pressure resistance and because only a glass base could meet the requirements. However, it has been found that the composite insulating member of synthetic resin or a ceramic material made in accordance with this invention can withstand the temperature and pressure stresses occurring in detonator pellets.

Moreover, it has been found that the composite insulating member of this invention does not need a metallic socket as necessary in case of a base made of glass; rather, the composite insulating member can be directly connected to a metallic cap or other components.

The invention will be furthermore described with reference to the following embodiment and to the accompanying drawing wherein.

Figure 1:
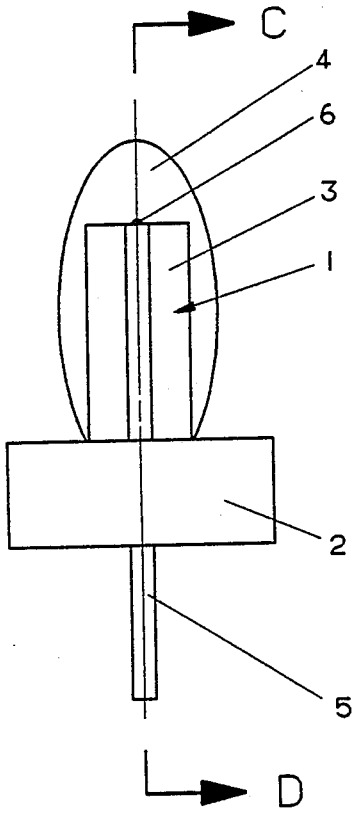
FIG. 1 is a side view of a detonator pellet.
Figure 2:
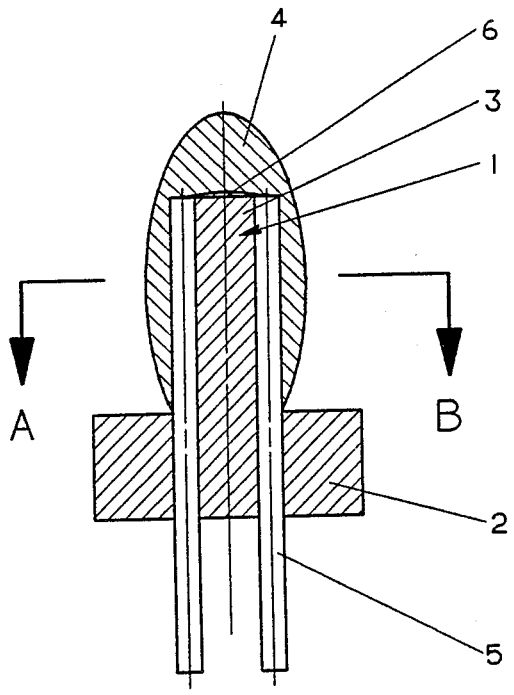
FIG. 2 is a longitudinal section through the detonator pellet of FIG. 1 (section C–D in FIG. 1)

The drawing shows merely the "bare" detonator pellet.

In most cases, the final detonator product, when offered for sale, is additionally surrounded by a metallic cap that can be directly attached by flanging to the composite insulating member of this invention.

The injection molded composite insulating member 1 has a disk-shaped base 2 and a central part or pole member 3, the shape and size of the latter being essentially determined by the desired droplet shape and size of the initiator mixture 4 which is formed around the central part. The cross section of the central part 3 is preferably rectangular (lateral widths of 1–3 mm and a height of 3–7 mm), the height being greater than the widths.

Figure 3:
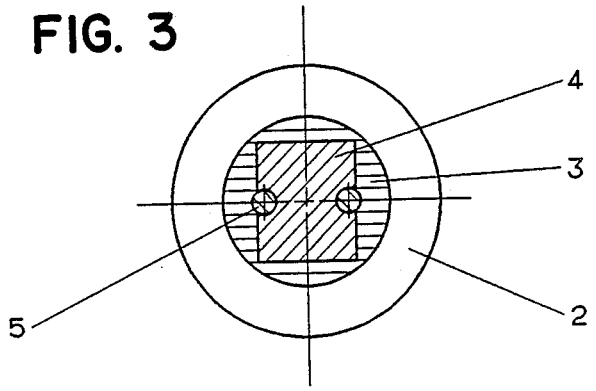
FIG. 3 is a cross section through the detonator pellet of FIG. 1 (section A–B in FIG. 2).

The metal wires 5, being lead-through and lead-in elements at the same time, extend within the central member. As can be seen especially from FIG. 3, preferably more that one-half the cross section of each wire extends in the central part 3 and terminates with the central part 3 adjacent to the topside of the central part. An ignition bridge 6 is soldered, welded or bonded to the wire ends across the topside of the central member.

In this embodiment, the composite insulating member is made from a polyamide resin (a suitable synthetic resin). It has been found surprisingly that even a synthetic resin which does not show extreme heat resistance can, owing to its strength and its insulating effect, fully perform its task during detonation as long as such properties are needed.

What is claimed is:

1. A detonator pellet comprising a base with two electrical contact members and a pole member, an ignition bridge connected to the contact members being attached to the topside of said pole member, and said pole member being surrounded by an initiator mixture in droplet shape; said base and said pole member being integrally formed of a composite insulating member exhibiting enhanced adhesiveness for the initiator mixture; said contact members comprising wires extending all the way through said composite insulating member to the ignition bridge and being supported by the composite insulating member.

2. A detonator pellet according to claim 1, wherein each of the wires extend within a portion of the composite insulating member with at least one-half of the cross section of each wire being within the insulating member.

3. A detonator pellet according to claim 1, wherein the composite insulating member consists of a synthetic resin that can be injection molded.

4. A detonator pellet according to claim 2, wherein the composite insulating member consists of a synthetic resin that can be injection molded.

5. A detonator pellet according to claim 1, characterized in that the composite insulating member consists of a ceramic material.

6. A detonator pellet according to claim 2, characterized in that the composite insulating member consists of a ceramic material.

* * * * *